US008807378B2

(12) United States Patent
Kaberna

(10) Patent No.: US 8,807,378 B2
(45) Date of Patent: Aug. 19, 2014

(54) TRASH CAN SYSTEM WITH A FOLDED BAG DISPENSING SUPPLY

(75) Inventor: Darren Kaberna, Woodland Park, CO (US)

(73) Assignee: Bright Ideaz Inc., Woodland Park, CO (US)

( * ) Notice: Subject to any disclaimer, the term of this patent is extended or adjusted under 35 U.S.C. 154(b) by 605 days.

(21) Appl. No.: 12/610,554

(22) Filed: Nov. 2, 2009

(65) Prior Publication Data

US 2010/0276427 A1 Nov. 4, 2010

Related U.S. Application Data

(60) Provisional application No. 61/110,671, filed on Nov. 3, 2008.

(51) Int. Cl.
*B65D 35/14* (2006.01)

(52) U.S. Cl.
USPC ..... 220/495.07; 220/908.1

(58) Field of Classification Search
USPC ..... 220/485.07, 908.1, 495.07, 908, 220/495.06, 495.01; 221/199, 33, 46, 38, 221/45, 48; 206/390, 395, 396, 554
See application file for complete search history.

(56) References Cited

U.S. PATENT DOCUMENTS

| | | | | |
|---|---|---|---|---|
| 3,451,453 | A * | 6/1969 | Heck | 206/390 |
| 4,823,979 | A | 4/1989 | Clark, Jr. | |
| 4,850,507 | A * | 7/1989 | Lemongelli et al. | 220/495.07 |
| 5,322,180 | A | 6/1994 | Ker | |
| 5,400,574 | A | 3/1995 | Spatafora | |
| 5,405,041 | A | 4/1995 | Van Brackle | |
| 5,497,903 | A | 3/1996 | Yoneyama | |
| 6,126,031 | A | 10/2000 | Reason | |
| 6,199,714 | B1 | 3/2001 | Thompson | |
| 6,840,401 | B2 | 1/2005 | Amundson | |
| 6,860,089 | B2 | 3/2005 | VanAlstine | |
| 2005/0029281 | A1 | 2/2005 | Westermann et al. | |
| 2006/0169697 | A1 * | 8/2006 | Koch | 220/495.07 |
| 2009/0101652 | A1 * | 4/2009 | Clardy et al. | 220/495.07 |

* cited by examiner

*Primary Examiner* — Jeffrey Allen
(74) *Attorney, Agent, or Firm* — Patent Portfolio Builders PLLC

(57) ABSTRACT

A trash can system and component elements are described. Folded or interfolded trash bags are provided in a container beneath a flexible insert. The flexible insert provides separation between a trash bag in an operative position within the trash can, and provides support to the container against the pulling operation performed by a user to pull a full trash bag out of the container and dispense a new, refill trash bag from the container. According to another exemplary embodiment, folded or interfolded trash bags are provided in a tray which slidably connect to a lid associated with a box disposed in the trash can.

9 Claims, 11 Drawing Sheets

TRASH CAN SYSTEM WITH A FOLDED BAG DISPENSING SUPPLY

RELATED APPLICATION

This application is related to, and claims priority from, U.S. Provisional Patent Application Ser. No. 61/110,671, to Darren Kaberna, filed on Nov. 3, 2008, having the same title, the disclosure of which is incorporated here by reference.

BACKGROUND

Changing bags in trash cans is a necessary, yet tedious, task which most people have performed either at home or at work. It is a chore that family members tend to dread, as well as one which does not add value to a company's business. Accordingly, techniques for making this chore easier and less time consuming are desirable and some have been proposed.

For example, various patents and patent applications have been proposed which address this chore by providing mechanisms for supplying bags within or as part of the trash can itself. For example, U.S. Patent Publication No. 2005/0029281 describes a trash container bag dispenser which can be universally fitted within any trash container having a generally flat central bottom portion. The dispenser is also removable from the trash container to replace the roll of bags and to clean the trash container. A single bag is individually dispensed within the trash container from a roll of bags. After a first bag is pulled from the trash bag dispenser, subsequent bags are automatically pulled therefrom when a preceding bag is filled and removed from the trash container. Most preferably, the attachment strips comprise mated self adhering hook and loop strips such as those sold under the ™ VELCRO.

Another example is found in U.S. Pat. No. 5,405,041. This patent describes, for example, a self dispensing trash liner pail which consists of a receptacle having a bottom wall and a plurality of upstanding side walls. A dispenser has a top slot formed therethrough. A structure is provided for retaining the dispenser to the bottom wall of the receptacle. A continuous length of a plurality of separable trash liners are carried as a roll within the dispenser. One trash liner at a time can be pulled out through the slot in the dispenser, be separated and used in the receptacle for the disposal of trash and similar articles. Other examples of such systems can be found, for example, in U.S. Pat. Nos. 6,199,714, 4,823,979, and 5,322,180.

However, there are certain potential problems associated with these existing solutions. For example, all of the above-mentioned systems provide trash bag or liner dispensers which carry the bags or liners in rolls. While this may be a convenient way to dispense trash bags or liners from disassociated boxes to replace individual bags in trash cans which do not include their own dispenser, it may pose certain problems when used in the context of an attached replenishment mechanism. For one thing, rolls require a certain amount of space and clearance to enable the roll to unroll while dispensing new bags. As another example, the amount of force needed to extract the next bag or liner to be used in the trash can can be relatively high since all of the bags in the roll must rotate in the dispenser in order to pull out the next bag and the force is being applied indirectly on the leading edge of the new bag coming from the roll.

In addition to being potentially troublesome in and of itself, the need for a relatively high degree of force to extract the next bag from the dispenser when rolls are used may also limit the choices available for connecting each of the bags together.

For example, if a relatively high degree of force is contemplated for pulling the bags from the dispenser, then the mechanism used to link the bags together will preferably be selected such that the bags stay linked together until the top of the new bag reaches the top of the trash can, i.e., it would be undesirable for the force used to pull the bags out to cause an early separation of the linked bags so that the user had to go digging into the dispenser to get the next bag out.

Accordingly, new trash can systems and methods for replacing bags or liners are needed.

SUMMARY

According to an exemplary embodiment, a trash can system includes a trash can having a bottom, at least one wall connected to the bottom, and a first opening, a box connected to, or integrally formed with, the bottom of said trash can, a lid which is removably connected to a top portion of said box and having a second opening formed therein, a support mechanism formed on a bottom surface of the lid, and a tray which contains a plurality of folded trash bags, and wherein the tray is slidably removable from the lid via tray edges which slide into the support mechanism on the bottom surface of the lid.

According to another exemplary embodiment, a trash bag dispensing retrofit system includes a box connectable to a bottom surface of a trash can, a lid which is removably connected to a top portion of the box and having an opening formed therein, a support mechanism formed on a bottom surface of said lid, and a tray which contains a plurality of folded trash bags, and wherein the tray is slidably removable from the lid via tray edges which slide into the support mechanism on the bottom surface of the lid.

According to an exemplary embodiment, a trash can system includes a trash can having a bottom, at least one wall connected to said bottom, and a first opening, a flexible insert, disposed inside of the trash can and in contact with at least one of the bottom of the trash can and the at least one wall of the trash can, the flexible insert having four legs connected to a body portion of the flexible insert, the body portion having a second opening formed therein, a baffle disposed around the second opening, and a container, disposed below the flexible insert inside of the trash can, the container having a third opening aligned with the second opening, the container holding a plurality of folded trash bags connected to one another in series, each of the plurality of folded trash bags having a leading edge and a trailing edge, wherein a first, unfolded trash bag is disposed in an operative position such that a surface of the first, unfolded trash bag generally conforms with the at least one wall and the first, unfolded trash bag has a fourth opening which generally conforms with the first opening of the trash can; and further wherein the leading edge of a second, folded trash bag is connected to the trailing edge bottom of the first, unfolded trash bag, whereby when the first, unfolded trash bag is removed from the trash can, the second, folded trash bag is pulled through the baffle and the second opening of the flexible insert to be placed into the operative position.

According to another exemplary embodiment, a dispenser for trash can bags includes a container holding a plurality of trash bags which are interfolded with one another in series, each of the plurality of folded trash bags having a leading edge and a trailing edge, and a flexible plastic membrane, disposed on top of and connected to said container, said flexible membrane having an opening therein through which bags can be individually dispensed and being adapted to provide separation between a dispensed bag and the plurality of trash bags which remain in the container.

According to another exemplary embodiment, a container of trash bags containing a plurality of interfolded trash bags, the container including an opening through which a leading edge of one of the plurality of interfolded trash bags can be dispensed, wherein when a trailing edge of the one of the plurality of interfolded trash bags is pulled through the opening, the trailing edge brings with it a leading edge of another of the plurality of interfolded trash bags based on the interfolding between the one of the plurality of trash bags and the another of the plurality of trash bags.

BRIEF DESCRIPTION OF THE DRAWINGS

The accompanying drawings, which are incorporated in and constitute a part of the specification, illustrate one or more embodiments and, together with the description, explain these embodiments. In the drawings:

FIG. 2(*b*) shows a side view of the flexible insert in an unexpanded mode and expanded mode according to an exemplary embodiment;

DETAILED DESCRIPTION

Figure 1:
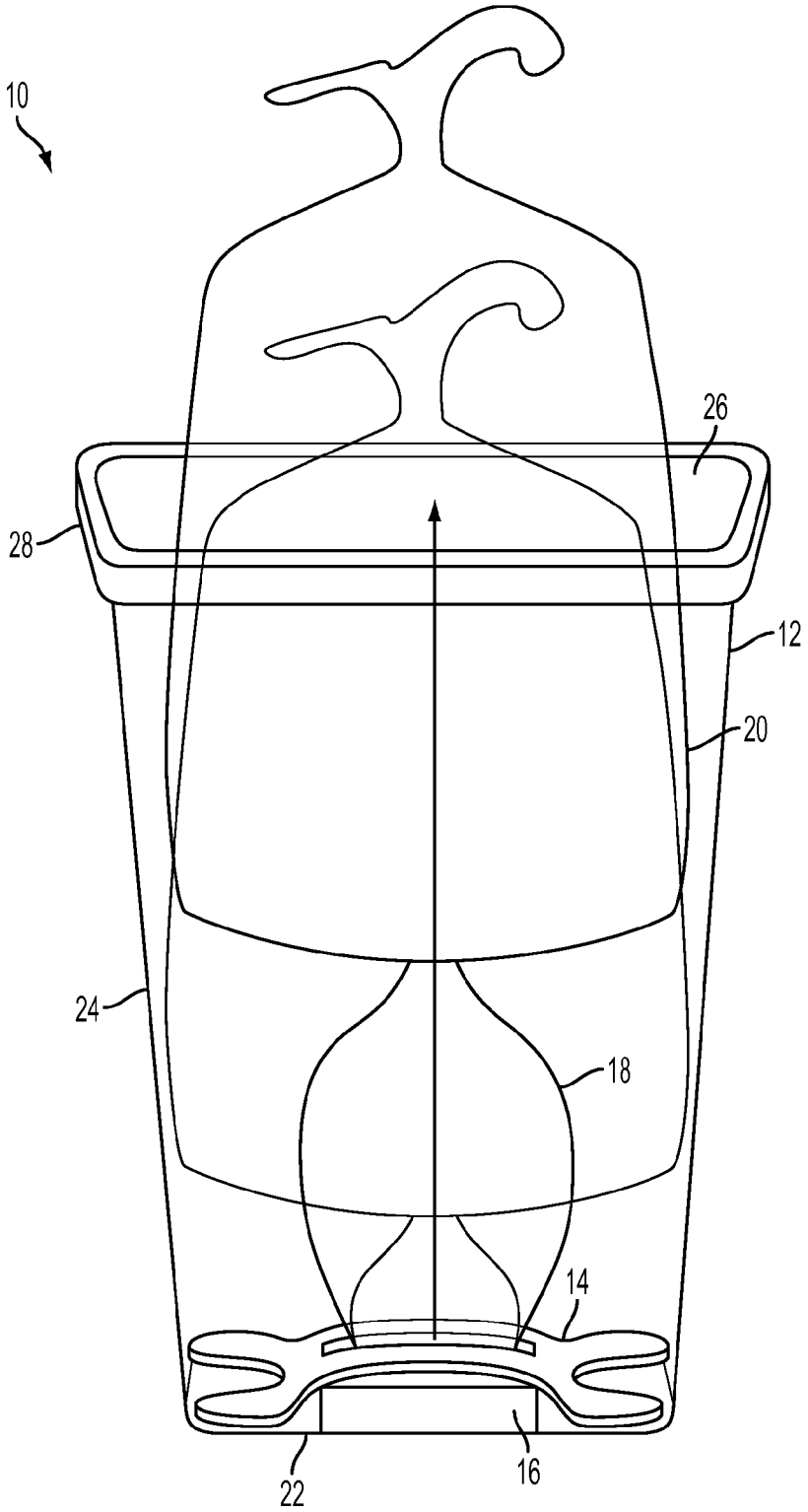
FIG. 1 illustrates a trash can system according to an exemplary embodiment.

The following detailed description of the invention refers to the accompanying drawings. The same reference numbers in different drawings identify the same or similar elements. Also, the following detailed description does not limit the invention. Instead, the scope of the invention is defined by the appended claims.

As mentioned above, it is considered desirable to provide a trash can system which provides for trash bag (or liner) refills to be dispensed from within the trash can using a supply of trash bags which does not come in a roll. According to one exemplary embodiment of the present invention, a trash can system draws from folded or interfolded trash bags in a supply container to replace a full bag as will now be discussed with respect to FIG. 1.

Therein, a trash can system 10 includes a number of elements such as a trash can 12, a flexible insert or membrane 14 and a container 16 for supplying a new trash bag 18 as the one 20 in the operative position becomes full and is removed. The trash can 12 will typically include a bottom 22 and at least one wall 24 connected to the bottom 22 and extending upwardly therefrom. An opening 26 is provided in the trash can 12 into which trash can be placed and from which a full bag can be removed. This particular, exemplary trash can 12 includes a lip formed around the opening 26 and is generally oblong in cross-sectional shape, however it will be appreciated by those skilled in the art that other shapes and designs, e.g., circular or oval trash cans, could be used instead and that the trash can 12 need not include a lip 28. The at least one wall 24 may be one continuous wall, e.g., for round or oval shaped trash cans 12, or may be a plurality of walls 24 delineated by edges or corners.

Figure 2A:
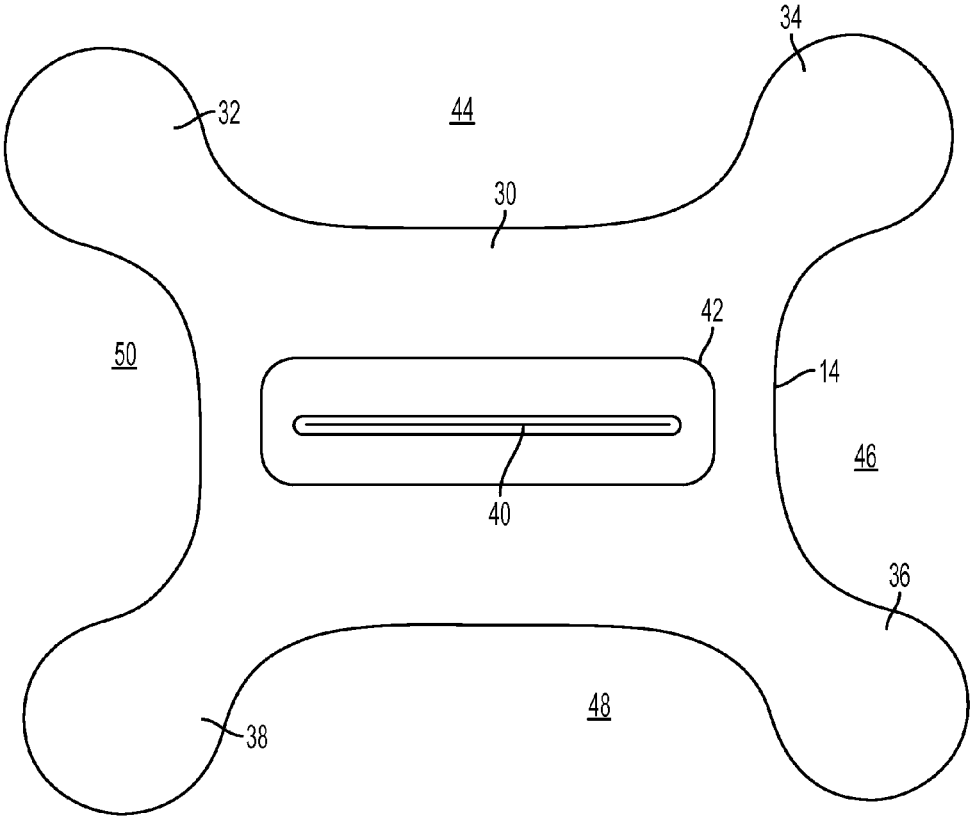
FIG. 2(*a*) shows a top view of a flexible insert according to an exemplary embodiment.
Figure 2B:
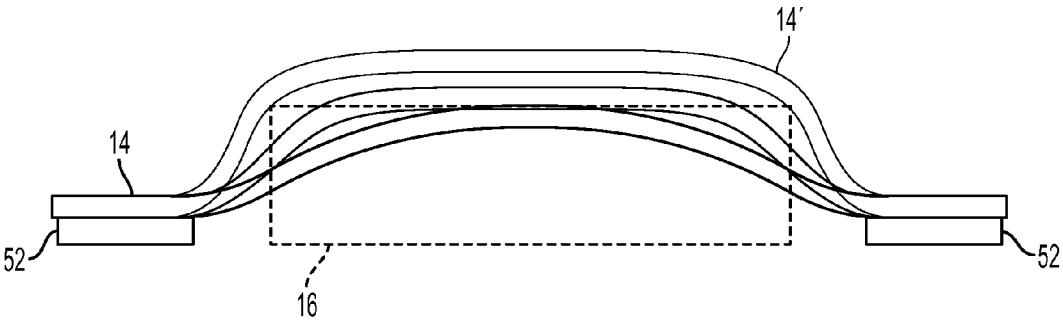

The flexible insert 14 can be made of plastic and is disposed inside of the trash can 12. It will typically be in contact with at least one of the bottom 22 of the trash can and the at least one wall 24 of the trash can 12, and provides a separation between the trash bag 20 which is in the operative position (i.e., is being filled with trash) and the container 16 which holds the supply of trash bags. Other details of the flexible insert 14 can be seen in FIGS. 2(*a*) and 2(*b*). FIG. 2(*a*) illustrates a top view of an exemplary flexible insert 14 according to this exemplary embodiment. Therein, it can be seen that the flexible insert 14 includes a body portion 30 and four legs 32, 34, 36 and 38 connected to the body portion 30 of the flexible insert 14. The flexible insert 14 also has an opening 40 through which the trash bags can be dispensed from the container 16. The flexible insert may, according to some exemplary embodiments also have a baffle 42 formed in the body portion 30 or attached thereto. The baffle 42 is disposed around the opening 40, which may itself be formed in the baffle 42 instead of the body portion 30 of the flexible insert. The baffle 42 aids in dispensing new trash bags as will be described in more detail below and may be fabricated from a harder, less flexible type of plastic than the plastic from which the flexible insert 14 is constructed.

The particular shape of the flexible insert 14 is not critical to the present invention and, therefore, it will be appreciated that the flexible insert 14 can be implemented having shapes or contours which are different than those illustrated in FIG. 2(*a*). However, the exemplary shape illustrated therein does convey certain potential advantages. For example, when disposed within the trash can 12, the legs 32-38 will typically be in contact with, or proximate to, the at least one wall 24 of the trash can 12. These legs 32-38 project outwardly from the body portion 30 of the flexible insert 34 at approximately 45 degree angles relative to a center area of the body portion 30 and define, between adjacent legs, openings or recesses 44-50. These openings thus will extend between the body portion 30 of the flexible insert 14 and the at least one wall 24 of the trash can 12 when the flexible insert 14 is inserted into the trash can 12 and provide, for example, a path for air to flow to the bottom 22 of the trash can 12. Additionally, these openings or recesses may provide sufficient space for a user to replace the container 16 of trash bags without removing the flexible insert 14, albeit removal of the flexible insert 14 may in some cases be required for replacing the container 16.

As shown in FIG. 1, the container 16 will be disposed below the flexible insert 14 inside of the trash can 12 when the entire trash can system 10 according to these exemplary embodiments is assembled. The flexible insert 14, in addition to separating the trash bag 20 in its operative position from the container 16, also provides support against the force used to pull the next replacement trash bag from the container 16. Thus, as shown in FIG. 2(*b*), the flexible insert 16 can be attached to the inside of the trash can 12 via, for example, a hooks and loops mechanism such as VELCRO® pads placed on one or more of the legs 32-38 of the flexible insert 14 and corresponding locations on the bottom 22 and/or at least one wall 24 of the trash can 12. Other mechanisms for attaching or connecting the flexible insert 14 to the trash can 12 could also be used in addition to, or as alternatives to, the hooks and loops fastener, e.g., a friction fit between at least some of the edges of the flexible insert 14 and the bottom 22 and/or the at least one wall 24 of the trash can 12 and/or slots could be fabricated in the trash can 12 into which the legs 32-38 of the flexible insert 14 can be inserted to provide a mechanical (yet removable) connection thereto. Other connection mechanisms could also be used. The insert 14 can alternatively be made from metal or can have metal inserts within the plastic legs to provide additional support and/or rigidity.

Also shown in FIG. 2(*b*), in dotted lines, is a container 16 which contains the supply of trash bags. This particular, exemplary container has a height which is greater at its edges than that of the flexible insert 14 in its unexpanded position. However, since the insert 14 is made of a flexible, plastic material, the insert 14 can flex or expand to the position shown by the insert 14' in FIG. 2(*b*) in order to accommodate larger containers 16. The container 16 will also include another opening (not shown in FIG. 2(*b*)) which will be generally aligned with the opening 40 in the body portion 30 of the flexible insert 14 (or baffle 42) when these two elements are assembled within the trash can system 10 to promote easy dispensing of the trash bags.

As mentioned above, the container 16 can hold a plurality of folded trash bags connected to one another in series, or interfolded relative to one another, each of the plurality of folded trash bags having a leading edge and a trailing edge. When a leading edge of a trash bag is withdrawn from the container 16 through the aligned openings in the flexible insert 14 and container 16, it unfolds into its operative position. In this context the operative position of a trash bag can be considered to be a position wherein the surface of the unfolded trash bag generally conforms with the wall(s) of the trash can 12 and the bag itself has an opening which generally conforms with the opening of the trash can 12. The leading edge of the trash bag may, or may not, be attached to the trash can 12 itself, e.g., using lip 28.

The trash bags 18, 20 may, for example, be arranged in the container 16 in any manner which provides convenient and reliable one-at-a-time dispensing of the replacement bags as full bags are withdrawn from the trash can, including rolls although rolled bags are not the preferred embodiment. For example, according to one exemplary embodiment, the trash bags may be folded (not rolled) and connected to one another serially in a manner which promotes separation between adjacent bags, e.g., with perforations or tabs placed in the web of bags at points which delineate different bags. According to another exemplary embodiment, the trash bags may be interfolded relative to one another using, e.g., a c-fold, z-fold or other interfolding configuration such that the removal of one bag through the openings removes a portion of the next bag in series through the openings due to the interfolded nature of the bags. More information on interfolding generally can be found in, for example, U.S. Pat. Nos. 5,497,203 and 6,840,401, the disclosures of which are incorporated here by reference. In the interfolded embodiments, the trash bags may also be physically connected to one another, e.g., via perforated or tabbed portions or may be physically unconnected to one another.

Figure 3:
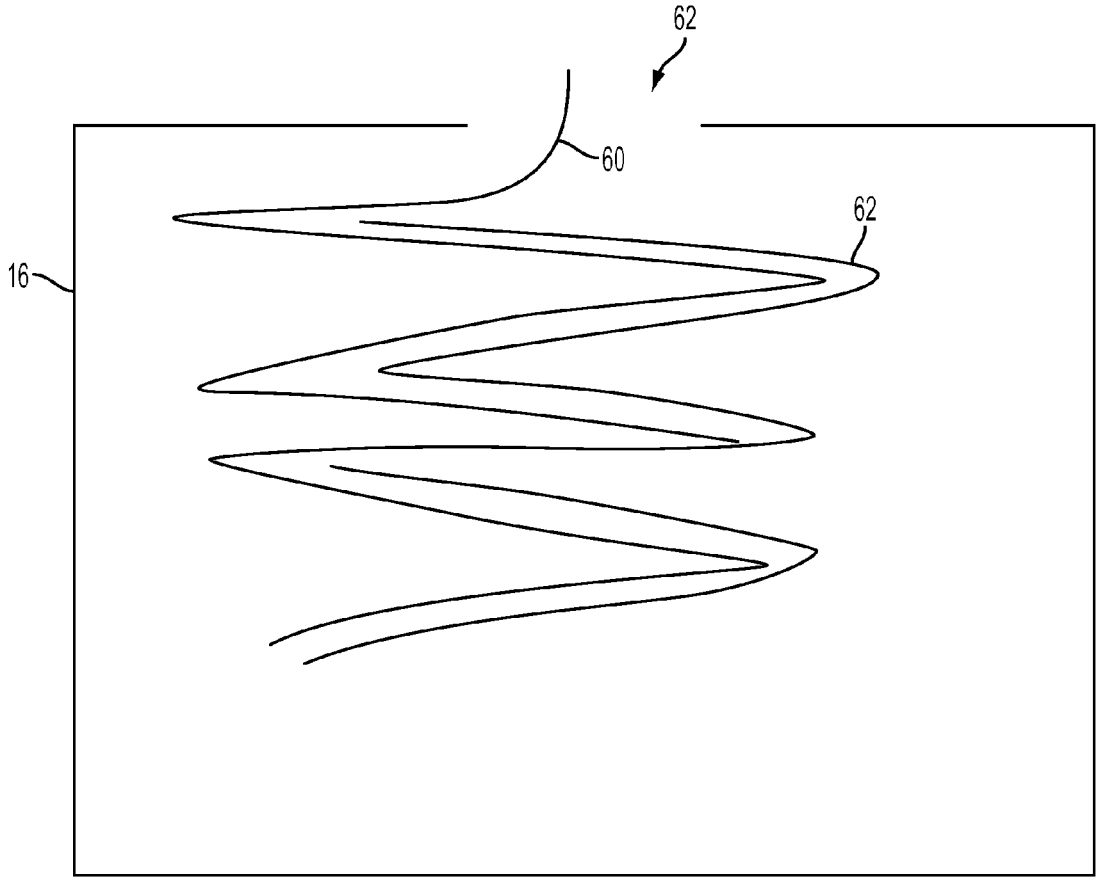
FIG. 3 illustrates an exemplary container of trash bags according to an exemplary embodiment.
Figure 4A:
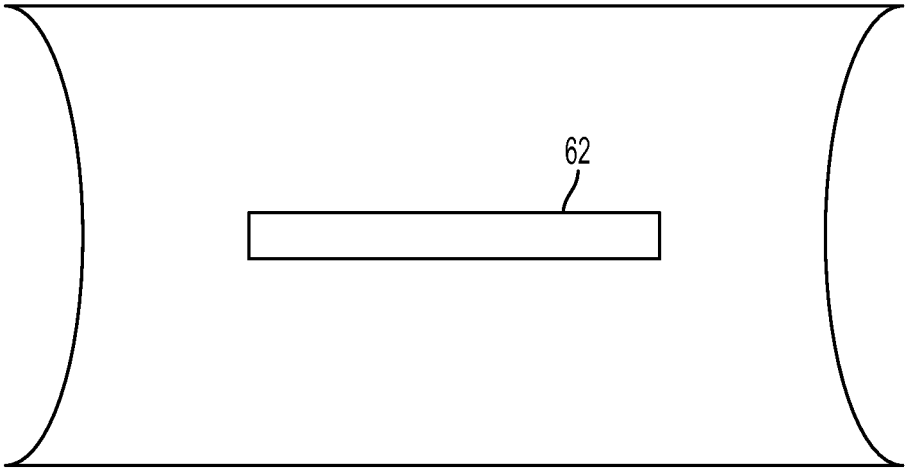
FIGS. 4(*a*) and 4(*b*) depict top views of exemplary pillow packs which can hold a supply of trash bags according to exemplary embodiments.
Figure 4B:
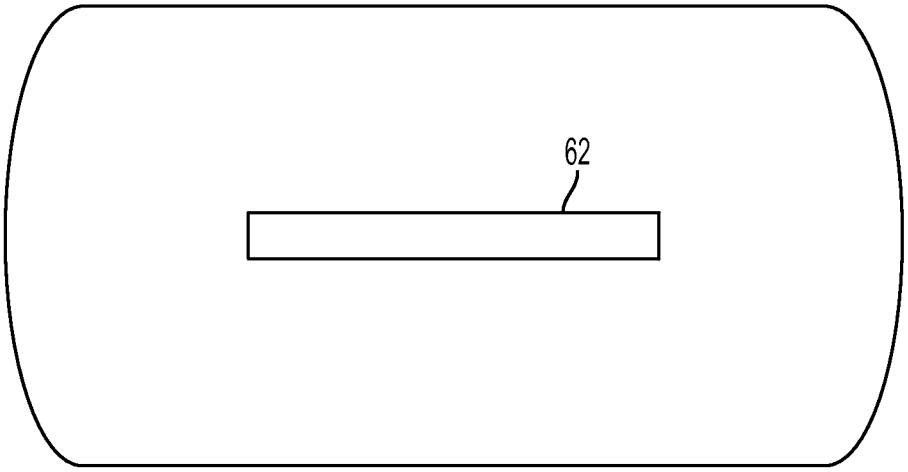
Figure 5A:
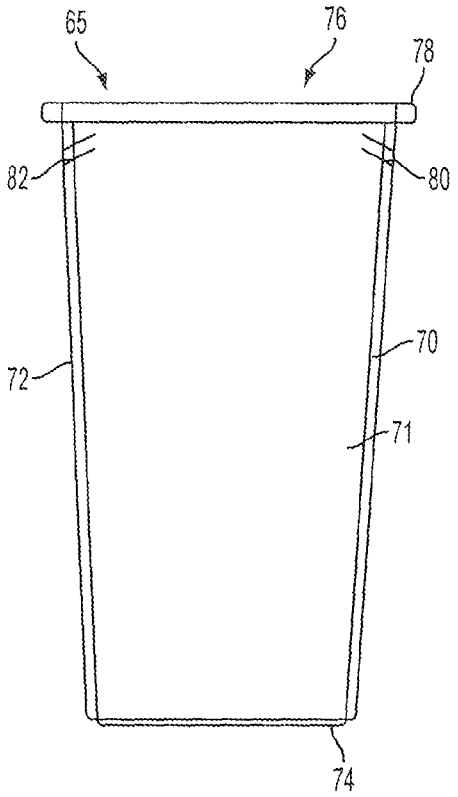
FIG. 5(*a*)-8 illustrate a trash can system according to another exemplary embodiment.
Figure 5B:
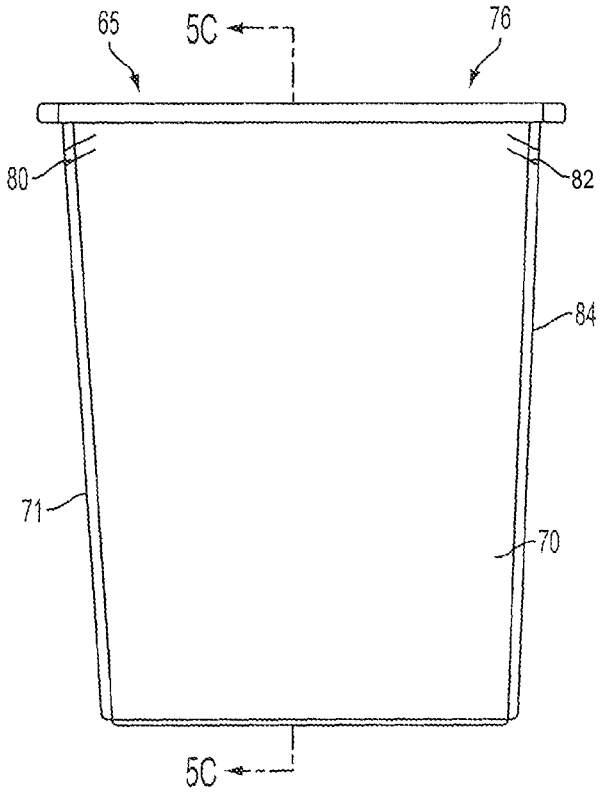
Figure 5C:
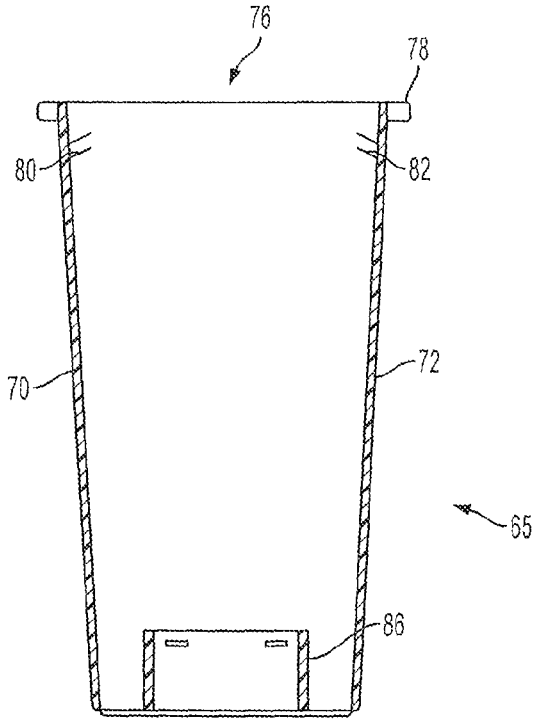
Figure 5D:
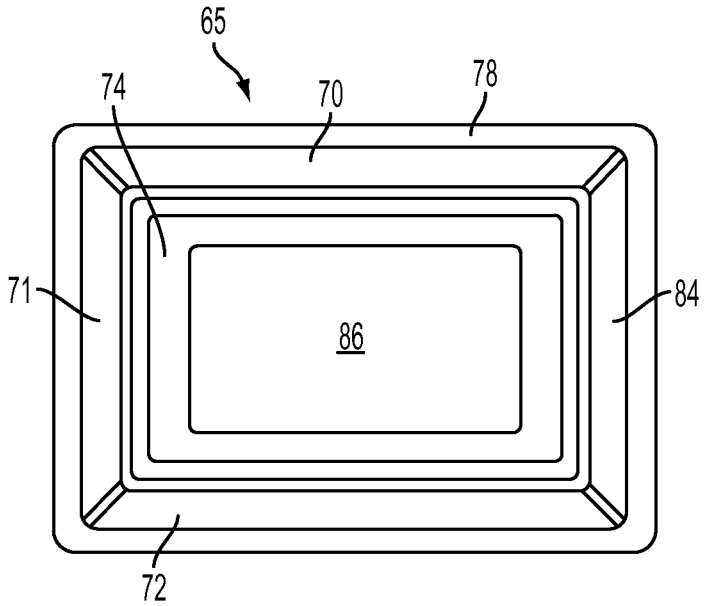
Figure 5E:
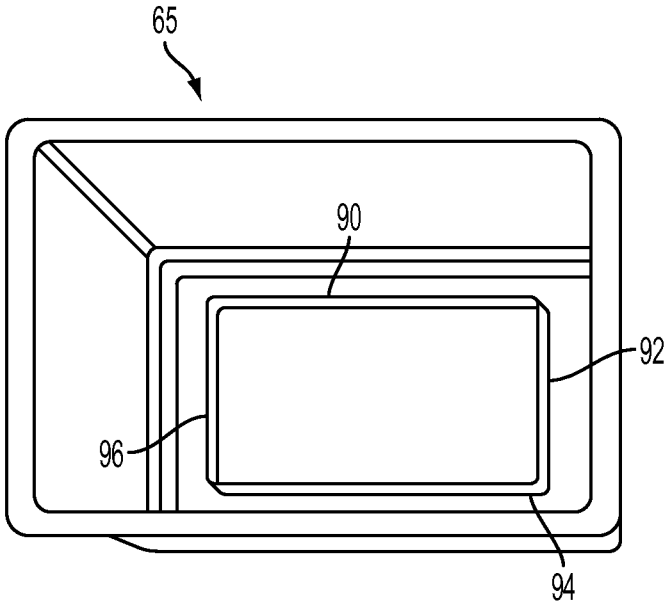
Figure 5F:
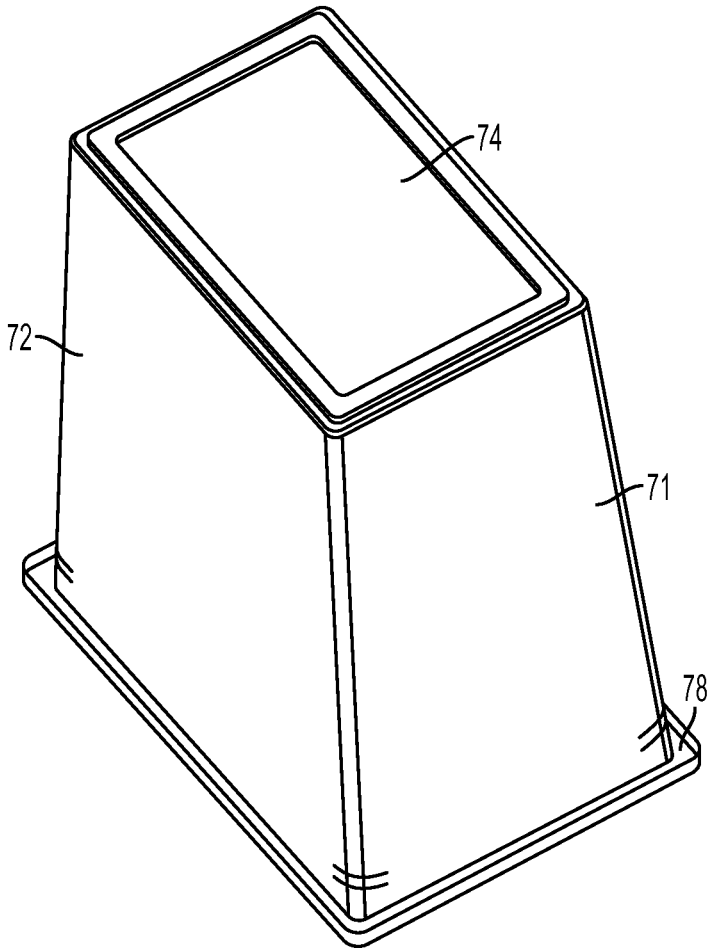
Figure 6A:
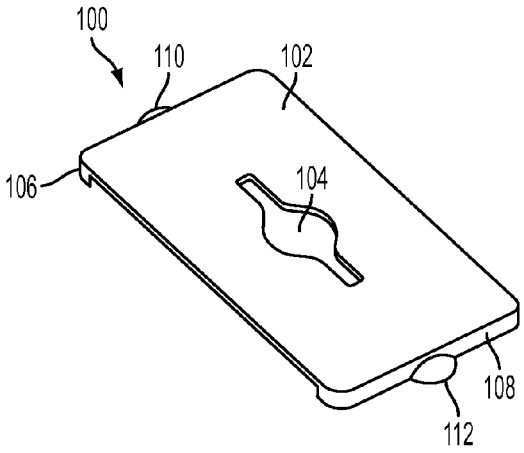
Figure 6B:
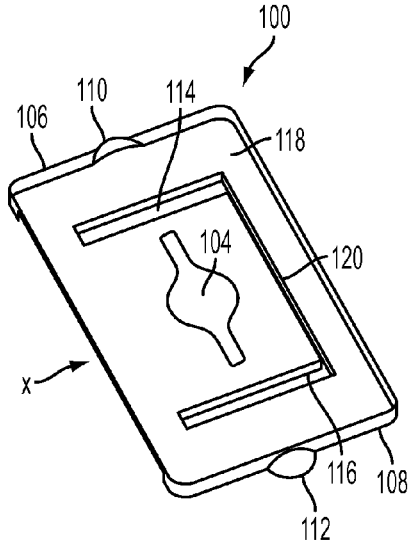
Figure 6C:
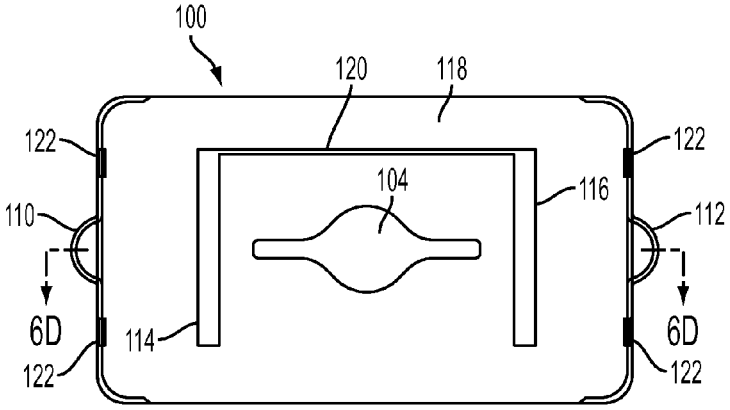
Figure 6D:
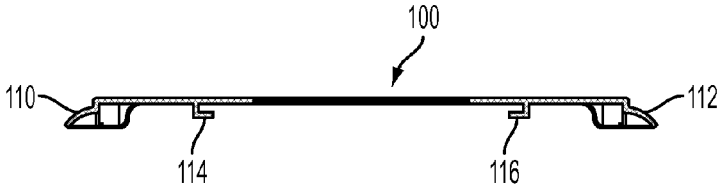
Figure 7A:
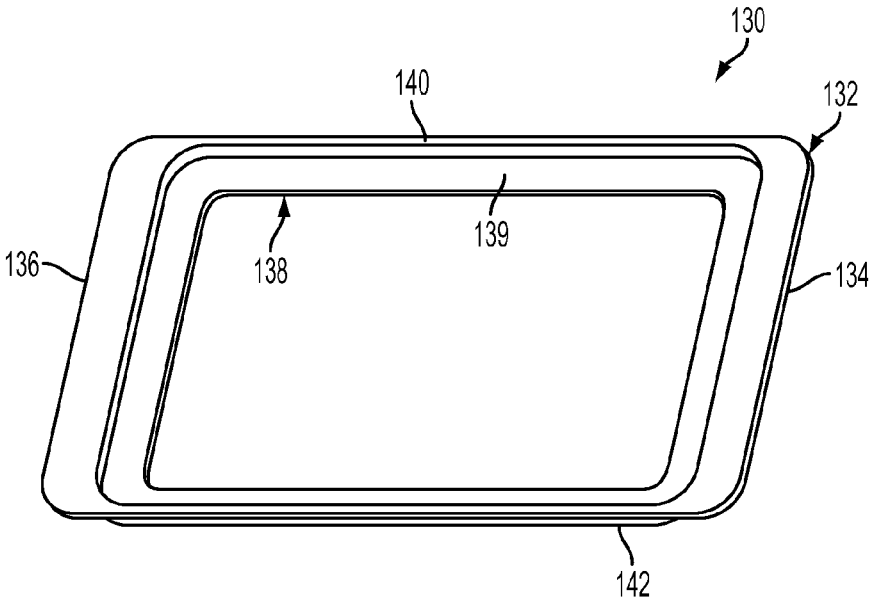
Figure 7B:
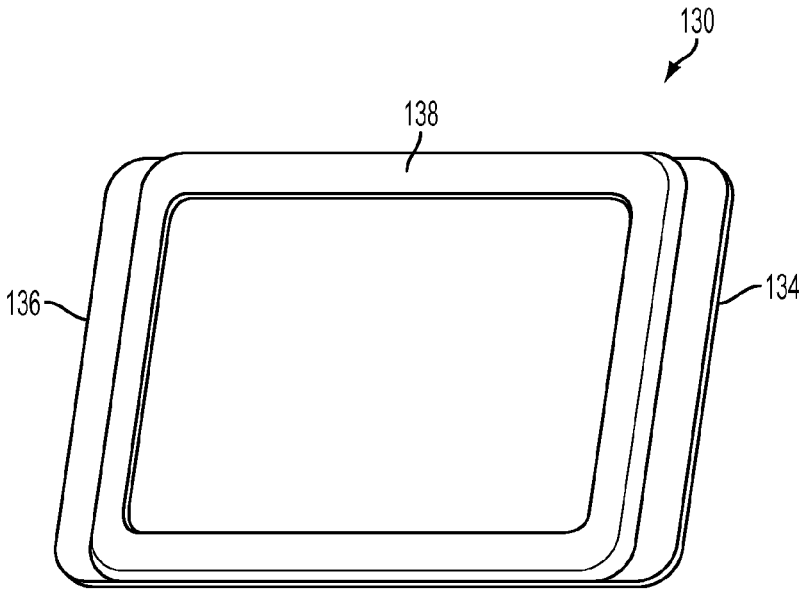
Figure 7C:
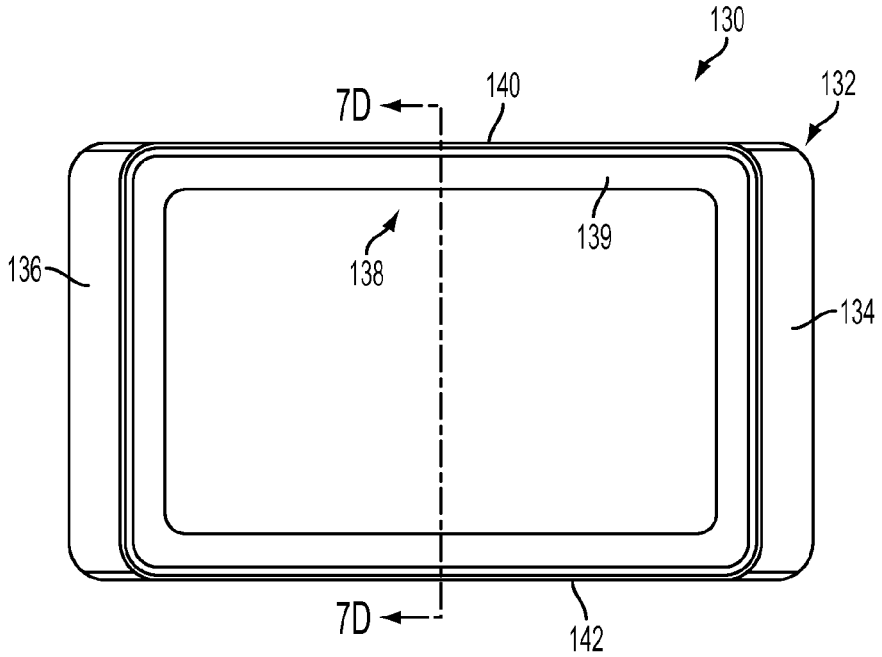
Figure 7D:
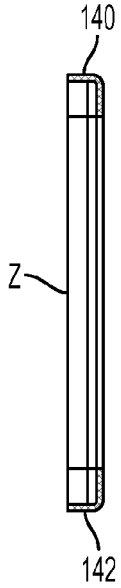

An exemplary container 16 containing interfolded trash bags is illustrated in FIG. 3. The container 16 can, for example, be fabricated as a so-called "pillow pack" or any other suitable container, and may have a housing or walls which are formed from a plastic made of a disposable and/or recyclable material or cardboard. Pillow packs are described in, for example, U.S. Pat. Nos. 5,400,574 and 6,860,089, the disclosures of which are incorporated here by reference. Generally speaking, one exemplary type of pillow pack includes arcuate end walls which may be either convex (FIG. 4(*a*)) or concave (FIG. 4(*b*)), e.g., formed of plastic which is heat sealed on the ends and then cut. The flexible insert 14 can be made of the same material as the container 16 or a different material. The container 16 and/or the trash bags which it contains may be treated with an antimicrobial compound such as "Duraban". According to one exemplary embodiment, the trash bags stored within the container 16 may include an indicator which indicates to the user that the supply of trash bags is running out. For example, the last few trash bags, e.g., 1, 2, 3, 4, or 5 bags, in the container can be a different color than those which were dispensed previously or have a different colored band near the top edge of the bag. Alternatively, a paper note could be provided near the end of the web of trash bags indicating an upcoming need to replace the container 16. Other indicators are also possible.

Returning to FIG. 3, therein it can be seen that a leading edge of a first trash bag 60 is extending through the opening 62 of the container 16. A second trash bag 62 is interfolded with the first trash bag 60, and a third trash bag 64 is interfolded with the second trash bag 62 such that the removal of one bag by a user will tend to pull the leading edge of the next bag in series through the opening 62 of the container 16. As mentioned above, although the trash bags shown in the container 16 of FIG. 3 are not physically connected together, easily separable physical connections between bags may be provided. The trash bags can, for example, be fabricated from either plastic or paper materials.

The trash can system illustrated in FIGS. 1-3 and described above can be provided as a complete, assembled system or in its component parts. Thus exemplary embodiments of the present invention may include (1) the trash can 12, the flexible insert 14 and the container 16 as an assembled unit, (2) the flexible insert 14 and the container 16 assembled together but without the trash can 12, or (3) the container 16 can be sold by itself with its supply of folded or interfolded trash bags. The flexible insert 14 can be fabricated as a separate element, as described above, or may be fabricated jointly with the container 16.

As mentioned above, providing trash bags or liners using folded or interfolded configurations as described above provides a number of benefits for resupplying the trash can according to these exemplary embodiments. For example, when a user is removing a full trash bag, which might be quite heavy, it is desirable that the extra force needed to start the next bag out from the container 16 be as low as possible. Using some of the foregoing exemplary embodiments, the leading edge of the new bag exits the opening of the container without the need to rotate an entire roll of bags.

Another exemplary embodiment is illustrated in FIGS. 5(*a*)-8. In this exemplary embodiment, a trash can system includes at least four elements, a can, a box disposed within the can, a lid which covers the box, and a plate which connects to the lid and which contains the trash bags to be dispensed, e.g., in a pillow pack as described above. Each of these elements will now be described in conjunction with the Figures, starting with FIG. 5(*a*). Therein a trash can 65 includes four sidewalls, three of which can be seen in the side view of FIG. 5(*a*), i.e., walls 70, 71 and 72, a bottom 74, and an open top 76 having a rim or edge 78 which extends outwardly from the four sidewalls. The trash can may, optionally, have one or more vents 80, 82 which are formed as openings in the side walls. These vents 80, 82 are intended to facilitate installation of the trash bags in the trash can 65. Typically, trash bags which are placed into a trash can will resist installation by "puffing up" since the air in the trash can has nowhere to escape as the trash bag is inserted into the can. However, according to some exemplary embodiments, these optional vents 80, 82 are intended to help this process by providing an escape for air in the trash can 65 as trash bags are moved in and out of their operative position.

FIG. 5(*b*) illustrates another side view of the trash can 65 which has been rotated 90 degrees relative to the view of FIG. 5(*a*). Therein the fourth wall 84 and another vent set 80, 82 can be seen. Although this exemplary embodiment provides for two vent slits at each corner, those skilled in the art will recognize that more or fewer vent slits could be provided, or that the vents could be omitted entirely. FIG. 5(*c*) provides a sectional view of the trash can 65 taken along the section lines A-A in FIG. 5(*b*). Of most interest in this Figure is the box 86 which is disposed in the bottom of the trash can 65 and in which the dispensable trash bags (not shown in this Figure) reside. Since the trash bags can be, as described above, provided as a pillow pack wherein the bags are interfolded relative to one another, the box 86 can be relatively small as compared to the height of the trash can 65. For example, according to one purely illustrative embodiment, the height of the box 86 may be 2 inches and the height of the trash can 65 may be 15 inches. Thus the ratio of the box height to trash can height is preferably 2/15 or less in order to reserve most of the room in the can 65 for the bag currently in use, although such a relationship is not a requirement of the present invention.

The box 86, which can be formed as an integral part of the trash can 65, e.g., by injection molding, or which can be formed separately and attached to the bottom 74 thereof, can also be seen in the top view of FIG. 5(*d*) and the isometric top view of FIG. 5(*e*). As shown, the box 86 will itself have four walls and may be centered on the inside surface of the bottom of the can 65. An isometric bottom view of the can 65 according to this exemplary embodiment is also illustrated as FIG. 5(*f*).

As mentioned above, the box 86 disposed within the trash can 65 interacts with a lid and a plate to form the dispensing mechanism associated with the trash can system according to this exemplary embodiment. FIGS. 6(*a*)-6(*d*) illustrate an exemplary lid 100 according to this exemplary embodiment. Therein, FIG. 6(*a*) is a top isometric view of lid 100. Top surface 102 of the lid 100 includes an opening 104 which is generally centrally located, and through which the trash bags (not shown in this Figure) can be dispensed. In this exemplary embodiment, opening 104 is shaped as a central circular opening having two horizontal offshoots extending therefrom, however those skilled in the art will appreciate that the opening 104 may take various shapes and sizes. The lid 100 also has two relatively short sidewalls 106, 108 which extend downwardly from the top surface 102 and which provide for a flexible, snap fit connection with the corresponding walls 92 and 96 of the box 86. Lid 100 may, thus, also be formed from a sturdy, yet flexible plastic material and may be provided with tabs 110 and 112 for a user to grip when removing the lid 100 from the box 86 (or when snapping the lid 100 onto the box 86). For example, to remove the lid 100 from the box 86, the user could pull outwardly on one or both of the tabs 110 and 112 to remove the sides 106 and 108, respectively, from their snap fit connection with sides 92, 96 of the box 86.

FIG. 6(*b*) shows the lid 100 from a bottom isometric perspective. Therein, a mechanism for removably securing the plate (not shown) to the lid 100 is shown as a set of rails 114 and 116 which are attached to the bottom surface 118 of the lid 100. The mechanism may also optionally include a backstop 120 attached to the bottom surface of the lid 100 and connected between the two rails 114 and 116. In operation, the plate (not shown) can be slid onto the rails 114 and 116 in the direction of the arrow X to arrive at an operative position whereby the trash bags supported by the plate can be dispensed through the opening 104. This will be better understood upon reviewing FIGS. 7(*a*)-7(*d*) which illustrate an exemplary plate. A non-isometric bottom view of the lid 100 is shown in FIG. 6(*c*). In addition to a slightly clearer view of the plate support mechanism 114, 116 and 120, four optional locking tabs 122 are seen in this view. The optional locking tabs 122 can be inserted into corresponding slots in the box 86 when the lid 100 is snapped onto the box 86. Two such slots (unnumbered) can be seen in the box 86 in FIG. 5(*c*). A cross-sectional view of the lid 100 taken along the section lines C-C in FIG. 6(*c*) is provided as FIG. 6(*d*). Therein, the three-dimensional nature of the rails 114 and 116 onto which the plate (not shown) slides and is then supported by the lid 100 are best seen.

Plate 130 according to exemplary embodiments is illustrated in FIGS. 7(*a*)-7(*d*). FIG. 7(*a*) depicts a top isometric view of plate 130 wherein it can be seen that the plate, which carries the trash bags (not shown), is essentially a two-tiered tray and is also referred to herein as a pillow pack tray. The upper tier 132 includes two tray edges 134 and 136 which can be slid into the lid 100 along rails 114 and 116, respectively, to position the trash bags (not shown in FIG. 7(*a*)) proximate opening 104 in the lid 100 when the plate 130 is slid fully into the support mechanism such that one of the long edges 140, 142 of the upper tier 132 abuts the backstop 120 of the lid. The lower tier 138 has a surface 139 on which the trash bags or a trash bag support, e.g., a cardboard or plastic bag holder or pillow pack, can rest or be affixed, e.g., glued. FIG. 7(*b*) shows a bottom isometric view of the plate 130, FIG. 7(*c*) illustrates a top, non-isometric view of the plate 130 and FIG. 7(*d*) shows a cross-sectional view of the plate 130 taken along the section lines A-A in FIG. 7(*c*).

Figure 8:
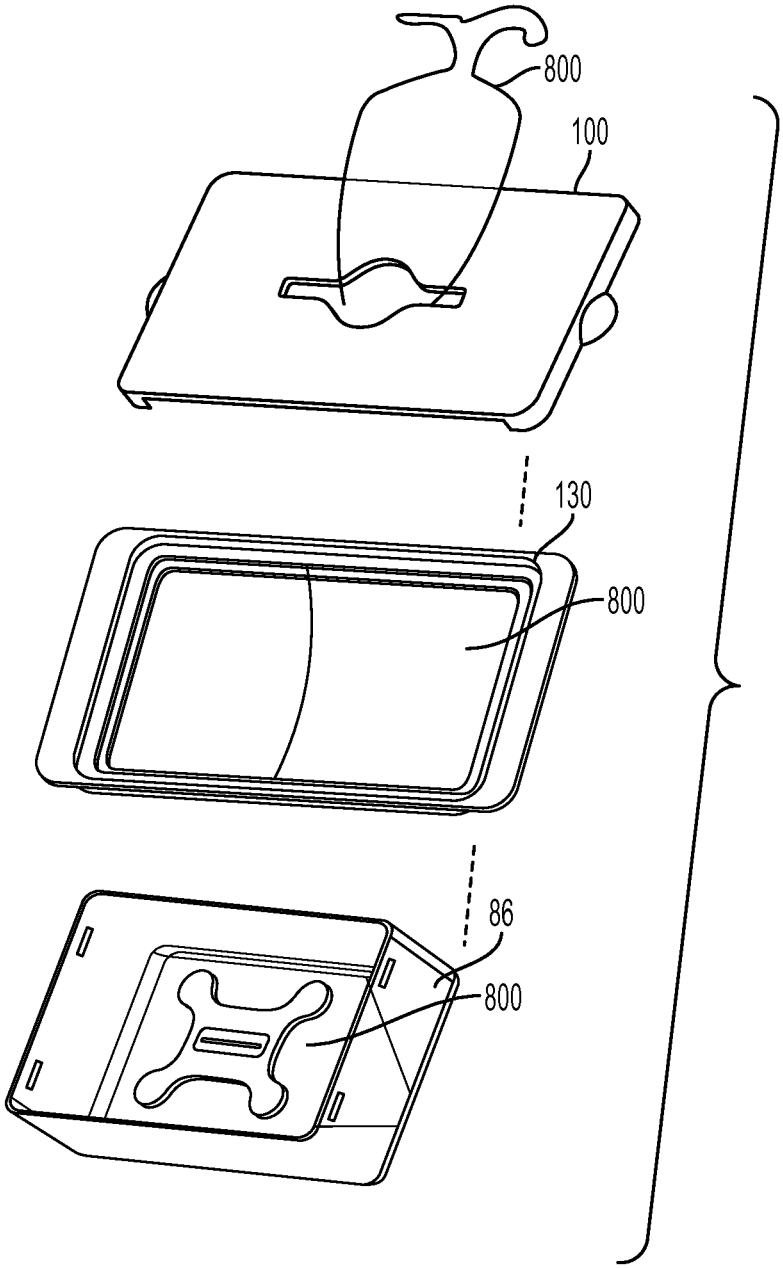

Thus, in operation, folded bags are supplied to the trash can via the plate 130 (pillow pack holder), which is inserted into the lid 100, that is in turn snapped onto the box 86 disposed in the bottom of the trash can. The exploded view of FIG. 8 shows conceptually how the folded or interfolded trash bags 800 are supported on plate 130 between the lid 100 and the box 86. The folded or interfolded trash bags 800 may hang below the plate 130 and into the box 86 where they form a dispensing supply. When a new bag is needed, it can be pulled up through the opening 104 in the lid 100. The manner in which the trash bags are folded or interfolded, and in which they are dispensed from their container, according to this embodiment may be any of the afore-described techniques used in conjunction with the exemplary embodiment of FIGS. 1-4. The elements shown in FIG. 8 (with or without the bags 800) may be provided as a separate unit for retrofitting existing trash cans by affixing the box 86 to the interior bottom surface of a trash can using, e.g., VELCRO strips, glue or other mechanical fasteners.

The above-described exemplary embodiments are intended to be illustrative in all respects, rather than restrictive, of the present invention. Thus the present invention is capable of many variations in detailed implementation that can be derived from the description contained herein by a person skilled in the art. All such variations and modifications are considered to be within the scope and spirit of the present invention. No element, act, or instruction used in the description of the present application should be construed as critical or essential to the invention unless explicitly described as such. Also, as used herein, the article "a" is intended to include one or more items.

What is claimed is:

1. A trash bag system comprising:

a rectangular shaped box having four walls which is connectable to a bottom surface of a trash can;

a rectangular shaped lid which is removably connected to a top portion of said box and having an opening formed therein;

wherein a set of rails and a backstop are formed on a bottom surface of said lid; and a rectangular shaped two-tiered plate including an upper tier and a lower tier, wherein said lower tier defines an opening, said upper tier surrounds said lower tier and establishes a raised surface which is vertically spaced from said lower tier;

wherein said upper tier and said lower tier are integrally formed together as said two-tiered plate, wherein said upper tier of said two-tiered plate includes plate edges such that said upper tier is slidable into and out of said set of rails on said bottom surface of said lid and abuts said backstop on said bottom surface of said lid, and wherein said lower tier of said two-tiered plate has a surface to which a holder of a plurality of folded trash bags is affixed.

2. The trash bag system of claim 1, wherein said lid snaps onto said box.

3. The trash bag system of claim 1, wherein said surface of said lower tier of said two-tiered plate is affixed to a pillow pack which holds said plurality of folded trash bags connected to one another in series, each of said plurality of folded trash bags having a leading edge and a trailing edge;

wherein a first, unfolded trash bag is disposed in an operative position such that a surface of said first, unfolded trash bag generally conforms with at least one wall and said first, unfolded trash bag has an opening which generally conforms with an opening of said trash can;

and further wherein said leading edge of a second, folded trash bag is connected to said trailing edge bottom of said first, unfolded trash bag, whereby when said first, unfolded trash bag is removed from said trash can, said second, folded trash bag is pulled through said opening of said lid to be placed into said operative position.

4. The trash bag system of claim 1, wherein said plurality of folded trash bags are connected to one another in series by way of at least one of: a c-fold, a z-fold, interfolding, perforations and tabs.

5. The trash bag system of claim 1, wherein said plurality of folded bags include an indicator which indicates that said plurality of bags are running out.

6. The trash bag system of claim 5, wherein said indicator is a color.

7. The trash bag system of claim 5, wherein said indicator is a paper note.

8. The trash bag system of claim 1, wherein said system is a retrofit unit that does not include said trash can, wherein said box is not connected to said bottom surface of said trash can.

9. The trash bag system of claim 1, wherein said system includes said trash can and said trash can comprises a bottom, at least one wall connected to said bottom, and a first opening; wherein said box having four walls is connected to, or integrally formed with, said bottom of said trash can.

* * * * *